United States Patent [19]

Jolly

[11] Patent Number: 4,601,121

[45] Date of Patent: Jul. 22, 1986

[54] TRIANGULAR GUN SIGHT

[76] Inventor: Thomas A. Jolly, 352 Loma Vista, El Segundo, Calif. 90245

[21] Appl. No.: 664,611

[22] Filed: Oct. 25, 1984

[51] Int. Cl.[4] ..... F41G 1/00; F41G 1/32; F21V 9/16

[52] U.S. Cl. ..... 42/100; 33/233; 33/241; 362/84

[58] Field of Search ..... 42/1 S, 1 SR; 33/241, 33/233; 362/84

[56] References Cited

U.S. PATENT DOCUMENTS

| | | | |
|---|---|---|---|
| 953,426 | 3/1910 | Mills | 33/241 |
| 1,329,075 | 1/1920 | Fornonzini | 42/1 S |
| 3,230,654 | 1/1966 | Smith | 42/1 SR |
| 4,192,075 | 3/1980 | Strahan | 42/1 S |

*Primary Examiner*—Deborah L. Kyle

*Assistant Examiner*—Michael J. Carone

*Attorney, Agent, or Firm*—Edward A. Sokolski

[57] ABSTRACT

A gun sight for a weapon such as a hand gun, rifle, shot gun, submachine gun, etc. The sight is a unitary member mounted on the top of the barrel of the weapon having a top surface in the form of an elongated isosceles triangle, the apex of which is towards the muzzle of the weapon. The base portion of the sight is attached to the weapon, the top surface forming a ramp which rises linearly from its rear end towards the apex of the triangle which is towards the muzzle end. The top surface of the sight is usually made white or some other light color, and can be of a luminescent material so that it is clearly visible in dim light, or the sight may be made of a transparent or translucent material such as a suitable plastic with a small battery operated lamp mounted therein.

5 Claims, 7 Drawing Figures

TRIANGULAR GUN SIGHT

This invention relates to a gun sight and more particularly to such a device which is particularly suitable for use under unfavorable lighting conditions.

The most commonly used gun sight known as the "post and notch" type sight employs a post or blade which is a fraction of an inch in height and thickness which projects upwardly near the the muzzle of the gun and is aligned by the shooter with a notch of some sort located towards the rear of the gun. This type of sight has been made in various forms including devices such as described in U.S. Pat. No. 4,192,075 to Strahan wherein the "post" is in the form of a ramp which rises towards the muzzle end. Another type of sight found in the prior art is described in U.S. Pat. No. 3,777,380 to Theodore, this device including rear and front notches—the front notch being relatively smaller than the rear notch and interconnected to the front notch by a converging open channel.

Other types of sights in popular use particularly on rifles include the "peep sight" which basically consists of 2 apertures one of which is mounted towards the rear of the weapon and the other towards the front of the weapon, the shooter aligning the two apertures so as to sight through them at the target; and the telescopic sight wherein the target is aligned with a pair of crosshairs through a telescope.

All of these prior art sights have the following shortcomings: The alignment of such sights with a target is somewhat difficult for anyone other than an expert with good eyesight and a steady hand particularly under conditions of stress, urgency and unfavorable light. Further, powerful handguns and rifles develop considerable recoil when fired such that after recoiling the weapon tends to be pointing straight up rather than horizontally at the target. This means that the alignment of the sight and target has to be re-established before the next shot can be fired which hinders rapid fire shooting both in competition and emergency situations. Also the human eye does not have the ability to focus on both near and far objects at the same time but in shooting is confronted with the need to see both the gun sight and the target simultaneously which poses a difficult optical exercise. Shooting instructors generally advise beginners to focus the eye upon the front sight and let the target go out of focus which works well in competitive shooting but is quite unsatisfactory when one is engaged in a combat situation shooting against multiple moving adversaries. Finally, and by far the most significant disadvantage of prior art sights is the increasing difficulty to use the sight as the light grows dimmer after nightfall making such sights almost totally useless under poor lighting conditions.

The sight of the present invention ameliorates and overcomes the aforementioned shortcomings of prior art gunsights in the following manner: Doing away with the conventional front and rear sight members and instead employing a single sight in the form of an elongated triangle which is inclined and tapers to its apex towards the muzzle, the shooter is presented with a view of an inclined plane in the form of an equilateral triangle. When the shooter fires the gun and the gun recoils, the view of the sight changes from that of an equilateral triangle to an isosceles triangle which is fully in the shooter's view during the time that it takes him to return the gun to firing position on the target, thus facilitating his bringing the gun back into firing position. If the shooter accidentally allows the muzzle to drop slightly while aiming he will still have a sight picture in the form of an obtuse isosceles triangle such that the gun can be readily brought back into line to present the desired equilateral triangle. This is as contrasted with the situation in using the "post and notch" system wherein upon recoil, or with dropping of the muzzle, the shooter completely loses his sight picture followed by a bothersome and time consuming reacquisition thereof.

Briefly described the device of the invention comprises a sight member which is attached to the top surface of the gun, this sight member having a top surface in the form of an elongated isosceles triangle having its apex towards the muzzle of the gun and inclined upwardly in the direction of the muzzle in the form of a ramp. The top surface of the sight is usually of a light color, is luminescent or is of an internally illuminated translucent or transparent material so that it is readily visible under low light conditions. The base of the elongated isosceles triangle is substantially equal to a side of an equilateral triangle formed at the end of the sight towards the muzzle. With the sight properly aimed at a target, the shooter will see the face of the sight as an equilateral triangle with the apex aligned at the point of the target at which the projectile will impact. If the shooter sees the sight as a scalene triangle either left or right, the projectile will impact either to the left or right of the target. When the shooter sees the sight as an obtuse isosceles triangle a low shot will result while an acute isosceles triangle will result in a high shot.

It is therefore an object of this invention to provide a novel gunsight which is particularly useful in low light conditions.

It is a further objective of this invention to provide an improved gun sight which is easier to aim than prior art sights.

It is a further objective of this invention to provide an improved gun sight which is better suited to rapid-fire than prior art sights.

Other objects of this invention will become apparent as the description proceeds in connection with the accompanied drawings of which:

Figure 4:
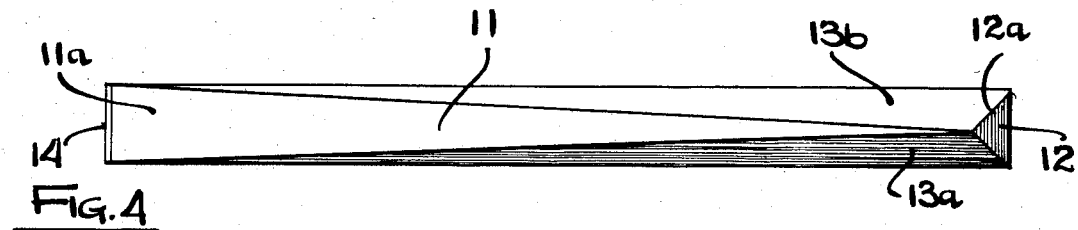
FIG. 4 is a top plan view of a preferred embodiment of the invention.
Figure 6:
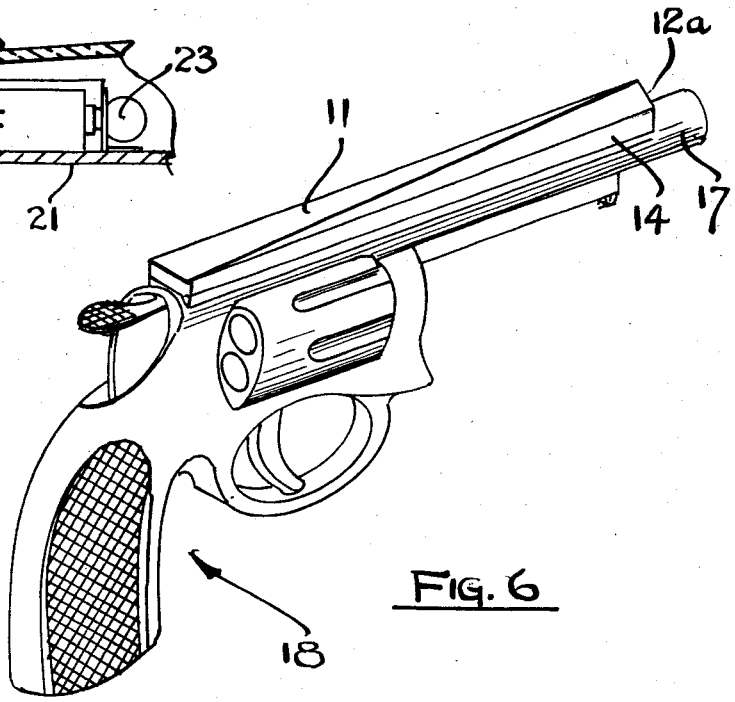
FIG. 6 is a perspective view illustrating the first embodiment of the invention installed upon a revolver.

Referring now to FIGS. 4 and 6, a preferred embodiment of the invention is illustrated. The sight of the preferred embodiment has a top surface 11 in the form of an elongated isosceles triangle, the base of which is towards the rear of the weapon, the apex of which is towards the muzzle of the weapon. The front end 12 of the sight is in the form of an equilateral triangle surface 11 sloping upwardly towards front end 12 with the apex of the elongated isosceles triangle being coincidental with the apex of the equilateral triangle. The rear edge 11*a* of surface 11 is equal in length to a side 12*a* of the equilateral triangle formed by end 12. Similar triangular portions 13*a* and 13*b* which taper towards the rear edge 11*a* of the sight form sloping sides of the sight which extend downwardly from surface 11. The sight has a rectangular base 14 which is used for mounting the device along the top surface including that of the barrel 17 of a gun. While the sight is shown for illustrative purposes mounted upon a revolver it may also be used to equal advantage with other weapons, such as rifles, shotguns, submachine guns, etc.

The sight may be attached to the gun by any conventional means such as for example by machining as part of the barrel, by means of screws or pins, by soldering or brazing, by means of clamps, by means of dovetail attaching brackets, etc. The top surface 11 of the sight is usually made white or other light color while the surfaces of the base 14 and side portions 13*a* and 13*b* are of a darker contrasting color, usually black or red.

If so desired the sight may be made adjustable for windage and elevation by mounting such sight on a pad for adjustment as shown for example in U.S. Pat. No. 4,192,075.

Figure 5:
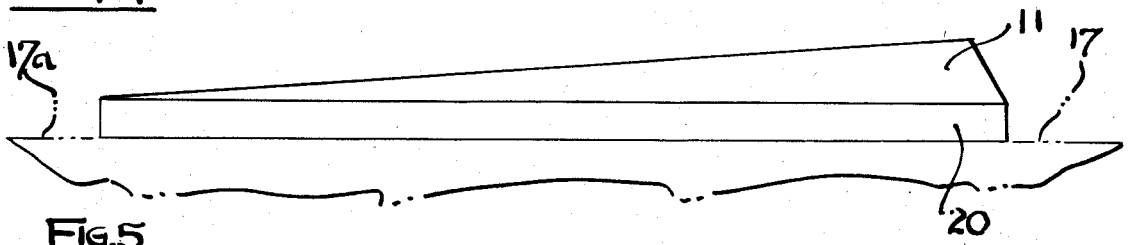
FIG. 5 is a perspective view of a second embodiment of the invention fabricated of transparent or translucent material.
Figure 7:
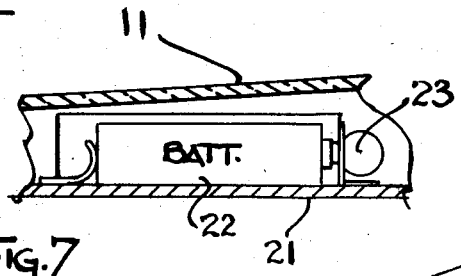
FIG. 7 is a crossectional view illustrating an illumination source which may be utilized in conjunction with the embodiment of FIG. 5.

Referring now to FIGS. 5 and 7 a second embodiment of the invention is illustrated. The second embodiment is fabricated of a light transmitting material such as lucite and has a top surface 11 in the form of an elongated isosceles triangle similar to the first embodiment. The sides 20 of this embodiment are rectangular in shape rather than triangular as for the first embodiment, the base of the sight being mounted on the barrel 17 of the gun with the apex of the triangle formed by the top surface being towards the muzzle end 17*a* of the barrel. Illumination is provided underneath the sight by means of a small battery 22 which illuminates a lamp 23, the lamp and battery being mounted in an enclosure formed between top surface 11 and bottom surface 21 of the sight.

Figure 1:
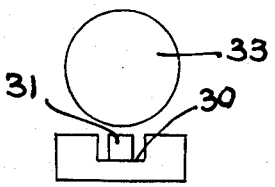
FIG. 1 PRIOR ART
FIG. 1 illustrates the sighting of a prior art "post and notch" sight in the "six o'clock hold" position.
Figure 2:
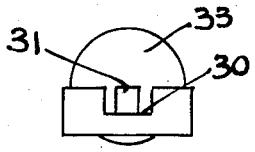
FIG. 2 is an illustration showing a prior art "post and notch" sight in the "center hold" position.
Figure 3:
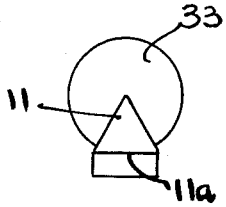
FIG. 3 is an illustration showing the sight of the present invention on "center hold" on a target.

Referring now to FIGS. 1–3, FIGS. 1 and 2 illustrate sighting with a typical prior art sight employing a notch 30 mounted on the rear of the gun and a post 31 mounted towards the muzzle of the gun. In FIG. 1 the target 33 is being sighted in the "six o'clock" hold position while in FIG. 2 the target is being sighted in the "center hold" position. FIG. 3 illustrates the sight of the present invention in the "center hold" position. FIG. 3 illustrates the sight of the present invention in the "center hold" position whereat it can be seen that the shooter sees the top surface 11 of the sight as an equilateral triangle; which is very easy to sight, and as pointed out earlier in the specification provides a basis for facilitating proper sighting in view of the fact that the view of the triangle changes to become scalene if the sighting is to the right or left obtuse isosceles if the sighting is low, and acute isosceles if the sighting is high.

The device of the present invention thus provides a simple yet highly effective gun sight which greatly facilitates accurate shooting and is particularly useful in situations of low visibility.

While the invention has been described and illustrated in detail, it is to be clearly understood that this is intended by way of illustration and example only and is not to be taken by way of limitation, the spirit and scope of this invention being limited only by the terms of the following claims.

I claim:

1. A gun sight for mounting on a gun having a muzzle, barrel and top surface, said sight comprising:

a base portion attached to the top surface of said gun, a top portion in the form of an elongated isosceles triangle having its apex towards the muzzle of the gun and its base towards the rear of the gun, said top portion rising linearly towards the muzzle of the gun, said top portion rising a distance substantially equal to the altitude of an equilateral triangle having a side equal in length to that of the base of said isosceles triangle, whereby when a target is sighted along said top portion of the sight, the gun is properly aimed when an equilateral triangle with its apex centered on the target appears in the sight.

2. The gun sight of claim 1 wherein said sight is fabricated of a light transmitting material and further including a light source mounted beneath the top surface portion of the sight.

3. The gun sight of claim 1 wherein said top portion is in the form of a flat surface.

4. The gun sight of claim 1, wherein said sight further has similar sloping triangular side portions between the base and top portions thereof, said side portions tapering towards the rear of the gun.

5. The gun sight of claim 4 wherein said sight further includes an end portion towards the muzzle of the gun in the shape of an equilateral triangle, the base of the elongated triangle of said top surface portion being equal in length to a side of said equilateral triangle.

* * * * *